US008105105B2

(12) United States Patent
Taniguchi et al.

(10) Patent No.: US 8,105,105 B2
(45) Date of Patent: Jan. 31, 2012

(54) ELECTRICAL CONNECTOR

(75) Inventors: Taro Taniguchi, Tokyo (JP); Akihiro Kodama, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/892,104

(22) Filed: Sep. 28, 2010

(65) Prior Publication Data

US 2011/0076898 A1 Mar. 31, 2011

(30) Foreign Application Priority Data

Sep. 30, 2009 (JP) ..... 2009-225682
Jun. 17, 2010 (JP) ..... 2010-138483

(51) Int. Cl.
*H01R 4/24* (2006.01)

(52) U.S. Cl. ..... 439/395

(58) Field of Classification Search ..... 439/395
See application file for complete search history.

(56) References Cited

U.S. PATENT DOCUMENTS

| | | | | |
|---|---|---|---|---|
| 4,749,365 | A * | 6/1988 | Magnifico et al. | 439/396 |
| 5,588,869 | A * | 12/1996 | Jensen et al. | 439/417 |
| 5,667,402 | A | 9/1997 | Denovich et al. | |
| 5,827,087 | A * | 10/1998 | Yamasaki | 439/395 |
| 6,908,331 | B2 * | 6/2005 | Brown | 439/395 |

FOREIGN PATENT DOCUMENTS

| | | | |
|---|---|---|---|
| JP | 49-083889 | A | 8/1974 |
| JP | 04-023057 | U | 2/1992 |
| JP | 07-226236 | A | 8/1995 |
| JP | 09-232010 | | 9/1997 |
| JP | 09-232010 | A | 9/1997 |
| JP | 2000-502207 | A | 2/2000 |

OTHER PUBLICATIONS

Office Action to Japanese Patent Application JP2010-138483, Sep. 21, 2011, Japanese Patent Office.

* cited by examiner

*Primary Examiner* — Gary F. Paumen
(74) *Attorney, Agent, or Firm* — Kubotera & Associates, LLC

(57) ABSTRACT

An electrical connector includes a housing and a terminal. The terminal is disposed in the housing. The terminal includes a pressing portion for receiving a wire and a connecting portion extending from the pressing portion. The pressing portion includes two elastic arm portions and a pressing groove portion between the elastic arm portions. The elastic arm portions includes a base portion extending from a connecting portion, a first arm portion extending from the base portion toward an opening portion of the pressing groove portion, a transition portion in a curved shape at a distal end portion of the first arm portion, and a second arm portion extending toward the base portion in parallel to the first arm portion. The elastic arm portions contact with the wire at inner edge portions of the second arm portions when the wire is inserted into the pressing groove portion.

7 Claims, 7 Drawing Sheets

ELECTRICAL CONNECTOR

BACKGROUND OF THE INVENTION AND RELATED ART STATEMENT

The present invention relates to an electrical connector a wire is pressed for contacting thereto.

A conventional electrical connector (a connector) is disclosed in Patent Reference. In Patent Reference, the connector includes a terminal made from a metal plate. The terminal includes a pressing groove portion (a slit) extending in a vertical direction or an insertion direction of a wire and an opening in an upper direction. The wire is inserted into the pressing groove portion in the insertion direction and comes into contact with two contact point portions. The contact point portion extends in the vertical direction and is formed as edge portions facing each other of the pressing groove portion. The contact point portion bites an outer jacket of the wire thus inserted, thereby contacting the wire. A hole portion is opened in the terminal along the contact point portion, in a range corresponding to the contact point portion in the vertical direction. The contact point portion is a beam portion formed with an edge portion and situated between the pressing groove portion and the hole portion. The beam portion has a fixed-fixed beam shape.

Patent Reference: Japanese Patent Publication No. 09-232010

In the conventional connector described above, when the wire is inserted into the pressing groove portion from the upper direction, the wire is pressed by the contact point portion where the contact point portion is situated in the vertical direction. Therefore, the beam portion deforms elastically outward against the pressing groove portion.

In the conventional connector in Patent Reference, a base portion in the both ends of the beam portion is fixed. Accordingly, the beam portion receives stress at the both ends or the base portions thereof upon deforming elastically. As a result, in the connector, it is possible to reduce the stress the terminal receives at one point since the beam portion receives the stress with two points, as opposed to a case the beam portion has a cantilever shape which receives the whole stress at one point. On the other hand, the beam portion does not deform easily since the beam portion is formed as the fixed-fixed beam. Therefore, the wire is not inserted into the pressing groove portion easily.

In addition, elasticity of the beam portion is unchanged regardless of a thickness of the wire or a position the wire is pressed. Therefore, it is difficult to provide a preferred contact condition corresponding to a variety of kinds of the wires. As a result, the contact point portion and the wire can fail to obtain the preferred contact condition in some cases.

In view of the problems described above, an object of the present invention is to provide an electrical connector which enables a terminal thereof to maintain a good contacting state with a wire by avoiding the terminal receiving the excessive stress. In addition, the electrical connector is able to provide a preferred contact condition corresponding to the variety of the kinds of the wires. Furthermore, the electrical connector enables the wire to be inserted into the pressing groove portion easily.

Further objects and advantages of the invention will be apparent from the following description of the invention.

SUMMARY OF THE INVENTION

In order to attain the objects described above, according to the present invention, an electrical connector includes a housing and a terminal disposed in the housing. The terminal includes a pressing portion for receiving a wire and a connecting portion extending from the pressing portion. The pressing portion has a plate surface perpendicular to a longitudinal direction of the wire.

In the electrical connector described above, in the present invention, the pressing portion includes two elastic arm portions and a pressing groove portion between the elastic arm portions. Upon receiving the wire, the elastic arm portion deforms elastically so that the pressing groove portion is widened. Each of the elastic arm portions includes a base portion extending from the connecting portion, a first arm portion extending from the base portion toward an opening portion of the pressing groove portion, a transition portion in a curved shape at a distal end portion of the first arm portion, and a second arm portion extending toward the base portion in parallel with the first arm portion. The elastic arm portions contact the wire with a pressing blade formed in each of inner edge portions of the second arm portions when the wire is inserted into the pressing groove portion.

In the electrical connector described above, when the wire is pressed to contact the pressing portion of the terminal, in other words, the wire contacts the pressing blade of the second arm portion, both of the first arm portion and the second arm portion deform elastically. Therefore, the base portion of the first arm portion receives stress as the first arm portion deforms and a base portion of the second arm portion receives stress as the second arm portion deforms, respectively.

As a result, the terminal receives the stress generated by pressing the wire with two points. Therefore, it is possible to reduce a burden the terminal receives. Consequently, the elastic arm portion does not diminish restoring force thereof due to the excess burden generated by the stress the elastic arm portion receives, and the contact blade of the second arm portion can maintain a state of contacting the wire with a sufficient contact pressure.

In the present invention, the base portion of the first arm portion is connected to the connecting portion. In addition, the distal end of the first arm portion continues to the second arm portion. The second arm portion has a distal end which is a free end. Therefore, the elastic arm portion has a cantilever shape extending from the base portion of the first arm portion and the free end of the second arm portion. In addition, the elastic arm portion has a length which is a sum of the first arm portion and the second arm portion. Therefore, the elastic arm portion has a sufficient length as a whole. Thus, since the elastic arm portion is flexible to deform elastically as the wire is inserted into the pressing groove portion, the wire can be easily inserted. Furthermore, the second arm portion extends toward the base portion of the elastic arm portion. Accordingly, a length of the terminal stays within a length of the first arm portion in the vertical direction. As a result, it is possible to avoid the pressing terminal growing in size.

In addition, the elastic arm portion includes two arm portions, that is, the first arm portion and the second arm portion. Elasticity of the whole elastic arm portion can vary depending on a position or a thickness of the wire. Therefore, it is possible to provide preferred contact conditions corresponding to a variety of kinds of the wires, thereby obtaining a good contacting state.

In the present invention, it is preferable that the pressing portion is arranged so that one of the first arm portion and the second arm portion elastically deforms when the wire is inserted into the pressing groove portion and situated within a range of the transition portion in an insertion direction, and both of the first arm portion elastically deform when the wire is situated within a range of the second arm portion in the insertion direction.

For example, the pressing portion can be formed so as to maintain a flat plate surface with the transition portion being curved at a distal end portion of the first arm portion to the pressing groove portion, and with the second arm portion extending toward the base portion of the first arm portion. In the pressing portion described above, right after the wire is inserted into the pressing groove portion, in other words, when the wire is situated within the range of the transition portion in a extending direction of the elastic arm portion, the wire does not apply stress to the second arm portion yet since the wire has not reached to the second arm portion. At this point, only the first arm portion deforms elastically. Therefore, only the base portion of the first arm portion receives the stress when the wire is situated within the range of the transition portion. As being pressed downward further, the wire quickly passes the range of the transition portion. As a result, the stress is not applied to only the base portion of the first arm portion for a long period of time. Consequently, the elastic arm portion does not diminish restoring force thereof.

When the wire is inserted further to a range of the second arm portion, both of the first arm portion and the second arm portion deform elastically. Accordingly, both base portions of the first arm portion and the second arm portion receive the stress. The second arm portion is situated close to the base portion of the first arm portion in the extending direction of the elastic arm portion. Therefore, essentially, the base portion of the first arm portion receives the relatively large stress.

In the present invention, the base portion of the second arm portion also receives the stress. Therefore, it is possible to reduce the stress the base portion of the first arm portion receives. Consequently, the elastic arm portion does not diminish the restoring force thereof since the pressing terminal receives lesser burden. Therefore, it is possible to maintain a state that the contact blade of the second arm portion contacts the wire with the sufficient contact pressure. Further, the second arm portion is situated close to the base portion of the first arm portion. Accordingly, the elastic arm portion as a whole can be capable of deforming elastically with a sufficient amount though the first arm portion independently deforms elastically with a little amount, since both of the first arm portion and the second arm portion deform elastically together.

It is preferred that the second arm portion includes a pressing protrusion portion on the inner edge portion thereof. Accordingly, even when the wire thus inserted has a core wire with a diameter equivalent to the width of the pressing groove portion, it is possible to maintain a connecting state of the wire and the terminal stably since the wire is sandwiched and pressed by the pressing protrusion portion.

It is preferable that the second arm portion includes a pressing region on the inner edge portion for defining a pressing position of the wire in the insertion direction. It is also preferable that the pressing region includes a bottom region for contacting with the wire when the wire is completely inserted, and rising edges rising from both end portions of the bottom region.

For example, when the inner edge portions extend tilting against the insertion direction, the wire can receive a force from the inner edge portion, in the insertion direction as well as in a direction the inner edge portions face each other, though the wire is inserted completely. In a case as described, by providing the pressing region in the inner edge portion of the second arm portion, the rising edge regulates a movement of the wire when the wire receives the force in the insertion direction. Consequently, the wire is kept within the bottom region or a regular position. Thereby, it is possible to attain the stable pressing contact at the regular position.

In addition, no matter if the inner edge portion extends tilting or not, when an external force in the insertion direction is applied to the wire inadvertently, a movement of the wire is regulated further by the rising edge. Accordingly, the wire is kept within the bottom region. As a result, it is possible to attain a stable pressing contact at the regular position.

In addition, in a case that a plurality of the wires are respectively inserted into the pressing groove portions of the corresponding terminals to specific positions using a jig and the like, though the thickness of the wires varies due to a manufacturing error and the like, the wires thus inserted can be kept within the bottom region since the rising edge regulates the further movement once the wires reach the bottom region.

It is preferable that the first arm portion includes a regulating protrusion portion protruding from an inner edge portion thereof to the second arm portion within a range of the second arm portion in the insertion direction of the wire for regulating the second arm portion to deform within a specific elastic deformation range. When the wire is inserted into the pressing groove portion, and the wire moves in a direction perpendicular to the insertion direction or toward one of the second arm portions, or a wire with a large diameter is inserted into the pressing groove portion, the regulating protrusion portion regulates the second arm portion to deform elastically within a specific range. As a result, the base portion of the second arm portion and the base portion of the first arm portion are not overstressed. Therefore the pressing terminal is not damaged due to being overstressed.

In the present invention, the connecting portion of the terminal can be connected to a corresponding circuit portion of a circuit board or a corresponding terminal of a mating connector.

As described above, in the present invention, when the wire is pressed into the pressing groove portion, both of the base portion of the first arm portion and the base portion of the second arm portion receive the stress generated by the elastic deformation of the elastic arm portion. Therefore, it is possible to reduce a burden the terminal receives. Thus, the elastic arm portion does not diminish the restoring force thereof. As a result, the terminal can maintain contacting the wire with a sufficient contact pressure.

In addition, the elastic arm portion includes a base portion of the first arm portion connected to the connecting portion, and the free end of the second arm portion. Accordingly, the elastic arm portion has the cantilever shape with a sufficient length and is flexible to deform elastically. Therefore, as the wire is inserted into the pressing groove portion, the wire can be easily inserted. Further, the elastic arm portion includes two arm portions, that is, the first arm portion and the second arm portion. The elasticity of the whole elastic arm portion can vary depending on the position or the thickness of the wire. Therefore, it is possible to provide the preferred contact condition corresponding to the variety of kinds of the wires, thereby obtaining the good contacting state.

Furthermore, the second arm portion extends toward the base portion of the elastic arm portion. Accordingly, the length of the terminal stays within the length of the first arm portion in the insertion direction. As a result, it is possible to avoid the pressing terminal growing in size.

BRIEF DESCRIPTION OF THE DRAWINGS

FIGS. 1(A) and 1(B) are perspective views showing an electrical connector according to a first embodiment of the present invention, wherein FIG. 1(A) shows a state that before the electrical connector presses a wire, FIG. 1(B) shows a state that the electrical connector has pressed the wire;

FIGS. 3(A) and 3(B) are sectional views only showing a terminal and the wire in FIG. 2(A), wherein FIG. 3(A) shows a state that the terminal presses the thick wire, FIG. 3(B) shows a state that the terminal presses the thin wire;

FIGS. 4(A) and 4(B) are views showing a terminal of an electrical connector according to a second embodiment of the present invention, wherein FIG. 4(A) is a perspective view and FIG. 4(B) is a front view;

FIGS. 7(A) and 7(B) are sectional views only showing a terminal and the wire of an electrical connector according to a fifth embodiment of the present invention, wherein FIG. 7(A) shows a state that the terminal presses the thick wire, FIG. 7(B) shows a state that the terminal presses the thin wire.

DETAILED DESCRIPTION OF THE PREFERRED EMBODIMENTS

Hereunder, embodiments of the present invention will be explained with reference to the accompanying drawings.

First Embodiment

Figure 1A:
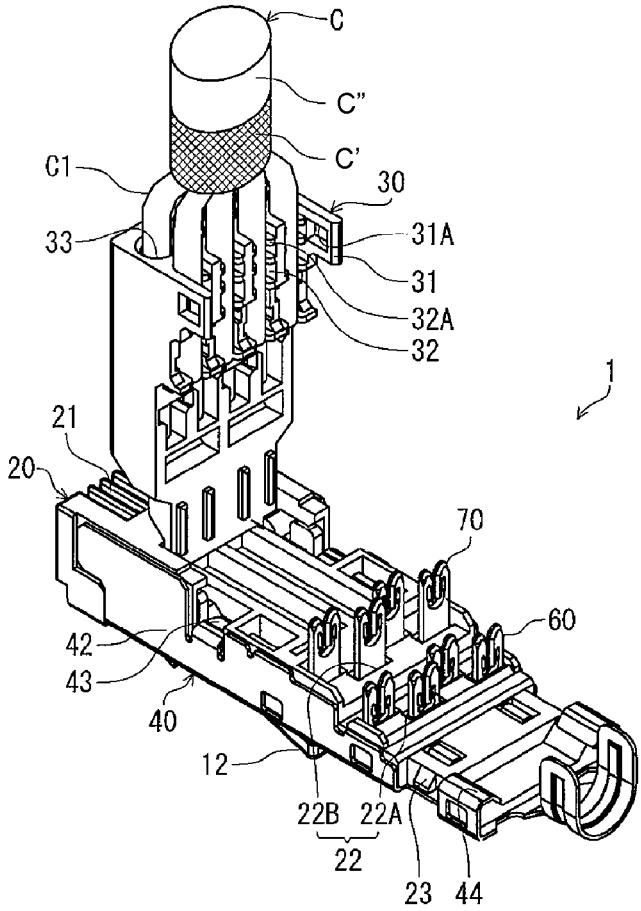
Figure 1B:
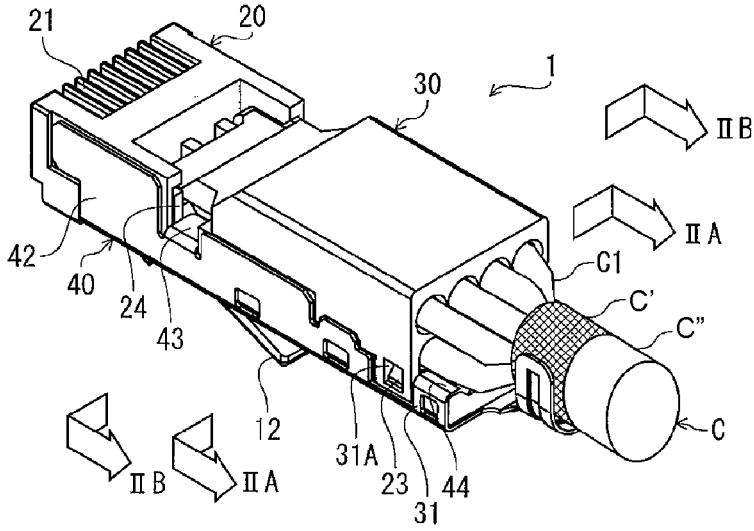
Figure 2A:
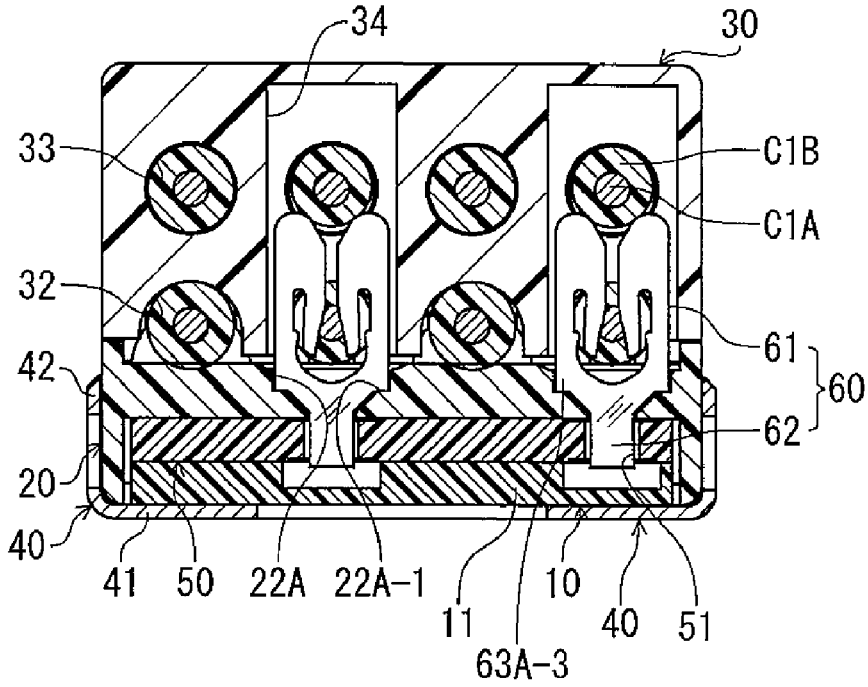
FIG. 2(A) is a sectional view taken along a line IIA-IIA in FIG. 1(B)

In the embodiment, an electrical connector according to the present invention is a modular plug 1, as one example of embodiments of the present invention. FIGS. 1(A) and 1(B) are perspective views showing the modular plug 1, wherein FIG. 1(A) shows a state that before a wire C1 is pressed, FIG. 1(B) shows a state that the wire C1 has been pressed. FIG. 2(A) is a sectional view taken along a line IIA-IIA in FIG. 1(B), that is, where a pressing terminal 60 (described later) is situated.

Figure 2B:
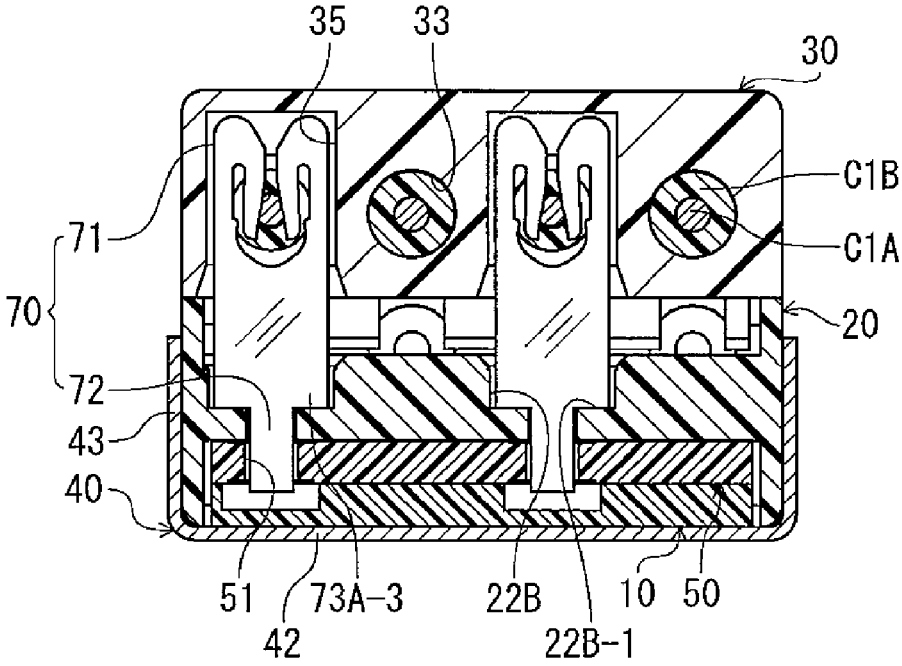
FIG. 2(B) is a sectional view taken along a line IIB-IIB in FIG. 1(B)
Figure 3B:
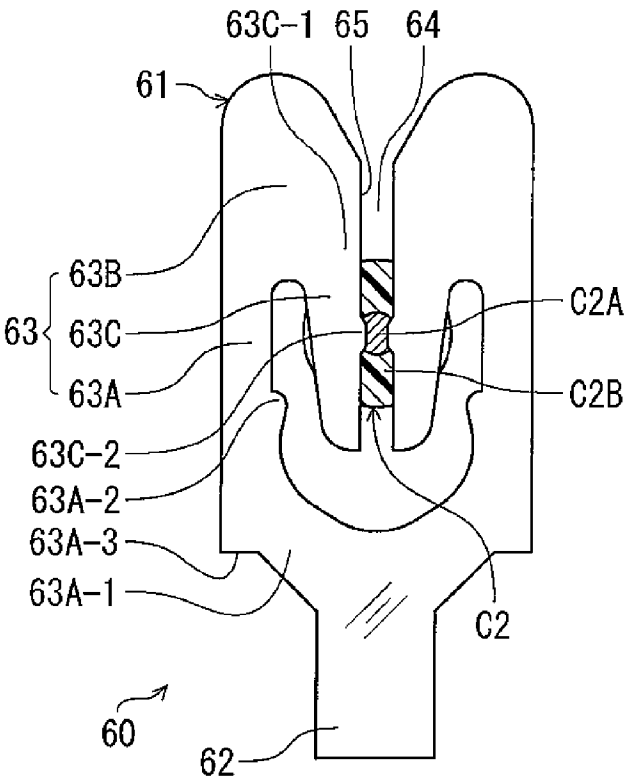
Figure 3A:
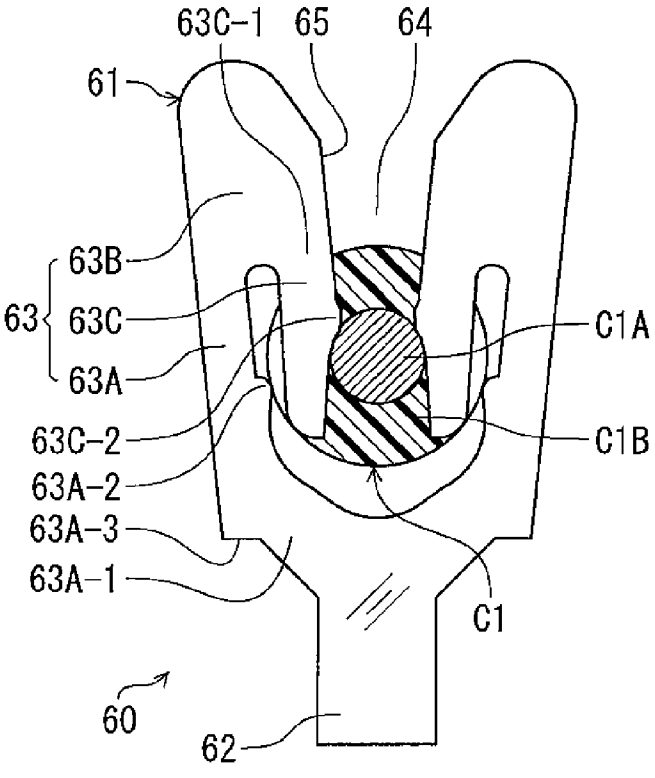

FIG. 2(B) is a sectional view taken along a line IIB-IIB in FIG. 1(B), that is, where a pressing terminal 70 (described later) is situated. In addition, FIGS. 3(A) and 3(B) are sectional views only showing the pressing terminal 60 and the wire in FIG. 2(A), wherein FIG. 3(A) shows a case that the wire C1 being pressed is thick, FIG. 3(B) shows a case that a wire C2 being pressed is thin.

The modular plug 1 according to the embodiment is fitted to a modular jack (not shown) from a forefront portion thereof, that is, a left end portion thereof in FIG. 1(B). Upon fitting to the modular jack, a plurality of the wires C1 is connected to the modular plug 1.

The plurality of the wires C1 is arranged in two rows in a vertical direction. In each of the row, the wire C1 is arranged in a width direction of the modular plug 1 and connected to the modular plug 1. The plurality of the wires C1 is bundled into a group and then covered with a shield wire C' and the shield wire C' is further covered with a sheathe C", thereby forming a cable C. The shield wire C' is composed of wires braided with each other. As shown in FIGS. 2(A), 2(B), 3(A) and 3(B), the wire C1 is formed with a core wire C1A made from a metal being covered with an outer jacket C1B made from a synthetic resin. In the embodiment, the core wire C1A is a solid wire. Instead, the core wire C1A may be a stranded wire formed with a plurality of strands.

The modular plug 1 includes a first housing 10, a second housing 20, a wire holding member 30, a metal shell 40, a substrate 50, a plurality of pressing terminals 60 and 70 made of metal and a plurality of plate terminals (not shown). The first housing 10 and the second housing 20 are assembled together and compose a housing main body (refer to FIGS. 2(A) and 2(B)). The wire holding member 30 and the metal shell 40 are attached to the second housing 20 from an upper direction and a lower direction, respectively. The metal shell 40 thus attached covers the housing main body. The substrate 50 is sandwiched and held between the first housing 10 and the second housing 20 (refer to FIGS. 2(A) and 2(B)). The terminals 60 and 70 are attached to a rear side portion of the substrate 50 and press the wire C1. The plate terminal is attached to a front side portion of the substrate 50 and contacts a mating terminal of the modular jack.

The first housing 10 is made from an electrical insulating material and includes a plate portion 11. As shown in FIGS. 2(A) and 2(B), the plate portion 11 extends in a front and rear direction (a direction perpendicular to the sheet) and has a plate surface which is horizontally flat with a substantially rectangular shape. As shown in FIGS. 1(A) and 1(B), from a front end portion of a lower surface of the plate portion 11, a locking piece 12 extends obliquely downward in a rear direction. The locking piece 12 is capable of bending. The locking piece 12 functions as an operating portion accepting a pressing operation toward the upper direction, when the modular plug 1 which is fitted to the modular jack (a fitting state of the connectors) is extracted from the modular jack.

As shown in FIGS. 1(A) and 1(B), the second housing 20 has a shape extending in the front and rear direction. Prior to an explanation of a configuration of the second housing 20, configurations of the substrate 50, the pressing terminals 60 and 70 to be attached to the substrate 50, and the plate terminal will be explained.

As shown in FIGS. 2(A) and 2(B), the substrate 50 extends in the front and rear direction (the direction perpendicular to the sheet) and includes a plurality of pressing terminal attaching holes 51 for attaching the plurality of the pressing terminals 60 and 70. The pressing terminal attaching hole 51 is provided in a rear end region of the substrate 50. Further, the pressing terminal attaching hole 51 penetrates the substrate 50 in the vertical direction. The pressing terminal attaching holes 51 are arranged in two rows and each row extends in a width direction of the substrate 50. Further, the pressing terminal attaching hole 51 is arranged in zigzag in each row. In addition, the substrate 50 further includes a plurality of plate terminal attaching holes (not shown) penetrating the substrate 50 in the vertical direction in a front end region thereof. The plurality of the plate terminals is attached to the terminal attaching holes and contacts the mating terminals of the modular jack.

The substrate 50 further includes a circuit portion (not shown) as an inner layer thereof. The circuit portion extends in the front and rear direction between the pressing terminal attaching hole 51 and the plate terminal attaching hole. The pressing terminals 60 and 70 attached to the pressing terminal attaching hole 51 and the plate terminal attached to the plate terminal attaching hole corresponding to the pressing terminal attaching hole 51 obtain electrical continuity through the circuit portion.

As shown in FIG. 1(A), the pressing terminals 60 and 70 situated in the rear side are arranged in the width direction of the substrate 50. The pressing terminal 60 is arranged in a rear row of the two rows of the terminals and the pressing terminal 70 is arranged in a front row of the two rows of the terminals. As described later, the pressing terminal 60 presses the wire C1 arranged in a lower level and the pressing terminal 70 presses the wire C1 arranged in an upper level. The pressing terminals 60 and 70 are made by punching out a metal plate and are arranged so that a plate surface thereof is perpendicular to the front and rear direction.

In addition, the pressing terminals 60 and 70 are arranged in zigzag in the width direction, respectively. In the embodiment, the pressing terminals 60 and 70 do not interfere with each other respectively, since the pressing terminals 60 and 70 are arranged in zigzag in each row. Therefore, it is possible to arrange the pressing terminals 60 and 70 with a narrow interval in a direction of the row or in a width direction of the second housing 20, respectively. It is also possible to hold the wire C1 held in the wire holding member 30 (described later) with a narrow interval in the width direction, so as to correspond to the pressing terminals 60 and 70. As a result, the second housing 20 and the wire holding member 30 can be downsized, eventually the modular plug 1 can be downsized in the width direction thereof.

A pressing portion of the pressing terminal 70 is identical with a pressing portion of the pressing terminal 60. Therefore, a configuration of the pressing terminal 60 will be explained mainly and an explanation of the pressing terminal 70 will be omitted. In FIG. 2(B), the pressing terminal 70 is shown with reference numerals added 10 to reference numerals of corresponding components of the pressing terminal 60.

As shown in FIG. 3(A), the pressing terminal 60 includes the pressing portion 61 for pressing the wire C1 and a connecting portion 62 for connecting to the circuit portion of the substrate 50. The connecting portion 62 extends downward from the pressing portion 61. The pressing portion 61 includes a pair of elastic arm portions 63. The elastic arm portion 63 extends in the vertical direction and is capable of elastic deformation in parallel with the sheet surface. Further, a pressing groove portion 64 is formed between edges of the pair of the elastic arm portions 63, which face each other. The pressing groove portion 64 extends in the vertical direction. As described later, the elastic arm portion 63 deforms elastically so as to open the pressing groove portion 64 in a horizontal direction in FIGS. 3(A) and 3(B), in other words, in a direction the elastic arm portions 63 move apart from each other. Thereby, the pressing groove portion 64 allows the wire C1 to enter therein from the upper direction.

Each of the pair of the elastic arm portions 63 has a symmetrical shape to each other about the pressing groove portion 64. The elastic arm portion 63 includes a first arm portion 63A, a transition portion 63B and a second arm portion 63C. The first arm portion 63A includes a base portion 63A-1 connected to the connecting portion 62. Further, the first arm portion 63A extends from the base portion 63A-1 toward an opening portion of the pressing groove portion 64, that is, extends in the upper direction. The transition portion 63B has a curved shape curving from a distal end of the first arm portion 63A to the pressing groove portion 64. The second arm portion 63C extends from the transition portion 63 toward the base portion 63A-1, that is, extends in the lower direction, in parallel with the first arm portion 63A.

As shown in FIGS. 3(A) and 3(B), two second arm portions 63C are situated between two first arm portions 63A. Accordingly, the first arm portion 63A is situated outside and the second arm portion 63C is situated inside. The first arm portion 63A is capable of elastic deformation around the base portion 63A-1 in a direction perpendicular to a thickness of the metal plate. The second arm portion 63C includes a base portion 63C-1 at a portion connected to the transition portion 63B. The second arm portion 63C is capable of elastic deformation around the base portion 63C-1 in a direction perpendicular to the thickness of the metal plate.

Upper inner edges of the transition portions 63B of the pair of the elastic arm portions 63 is formed so as to be apart from each other, thereby widening an upper portion of the opening portion of the pressing groove portion 64. Accordingly, the wire C1 can be led easily into the pressing groove portion 64.

In the embodiment, as described above, one end of the first arm portion 63A, that is, the base portion 63A-1 is connected to the connecting portion 62. In addition, the distal end of the first arm portion 63A continues to the second arm portion 63C having a distal end which is a free end. Therefore, the elastic arm portion 63 has a cantilever shape with a sufficient length. Thus, since the elastic arm portion 63 is flexible to deform elastically, the wire C1 can be inserted easily into the pressing groove portion 64. Furthermore, it is possible to avoid the pressing terminal 60 growing in size, since the second arm portion 63C extends in the lower direction within a length of the first arm portion 63A in the vertical direction.

As shown in FIG. 3(A), the first arm portion 63A includes a regulating protrusion portion 63A-2 within a range of the second arm portion 63C in the vertical direction. The regulating protrusion portion 63A-2 protrudes from an inner edge portion of the first arm portion 63A to the second arm portion 63C. As described later, the regulating protrusion portion 63A-2 regulates the second arm portion 63C to deform elastically within a specific range. Further, an outer edge portion of the base portion 63A-1 of the first arm portion 63A juts toward outside, thereby forming an abutting portion 63A-3 in a lower edge of a portion thus jutting. The abutting portion 63A-3 abuts the second housing 20 in the vertical direction.

The elastic arm portion 63 includes a contact blade 65 at an edge portion thereof extending from the transition portion 63 to the second arm portion 63C, in other words, an inner edge portion of the elastic arm portion 63 facing one another. As described later, the wire C1 pressed into the pressing groove portion 64 is pressed against a lower portion of the contact blade 65, that is, an inner edge portion of the second arm portion 63C. Further, the second arm portion 63C includes a pressing protrusion portion 63C-2 in the inner edge portion thereof. The pressing protrusion portions 63C-2 of the pair of the second arm portions 63C are formed to come close to each other, thereby narrowing the pressing groove portion 64. As described later, the pressing protrusion portion 63C-2 contacts the core wire C2A with a contact pressure as the wire C2 having the fine core wire C2A is pressed into the pressing groove portion 64 (refer to FIG. 3(B))

As shown in FIG. 2(B), in the pressing terminal 70 arranged in the front row, a portion that a base portion 73A-1 of an elastic arm portion 73A is connected to a connecting portion 72 is formed to be longer in the vertical direction than a corresponding portion of the pressing terminal 60. Thus, a pressing portion 71 is situated in an upper position than the pressing portion 61 of the pressing terminal 60.

In the embodiment, the pressing terminals 60 and 70 are formed so as to maintain the plate surface flat through a whole region of the plate surface thereof. Therefore, the first arm portion and the second arm portion are situated in the same plane which is perpendicular to the thickness of the metal plate, in other words, which is parallel with the sheet surface in FIGS. 3(A) and 3(B). Instead, the first arm portion and the second arm portion may be situated in deferent plains from each other in a direction of the thickness of the metal plate, by bending the transition portion.

The plate terminal contacts the mating terminal of the modular jack in the fitting state of the connectors. The plate terminal is formed by punching out a metal plate. The plate terminal includes a contact portion having a plate surface with a substantial rectangular shape and a connecting portion extending in the lower direction from a lower edge portion of the contact portion. The plurality of the plate terminals is disposed so that the plate surface thereof becomes perpendicular to the width direction of the substrate 50. The connecting portion of the plate terminal is inserted into the plate terminal attaching hole of the substrate 50 from the upper direction and then soldered to the substrate 50.

Next, the second housing 20 will be explained. The second housing 20 is made from an electrical insulating material and as shown in FIG. 1(A), extends in the front and rear direction. The second housing 20 includes a terminal receiving groove 21 for receiving the plate terminal in a front end portion thereof. A plurality of the terminal receiving grooves has a shape like a comb and opens in the upper direction and a front direction.

The second housing 20 further includes a pressing terminal holding region for disposing and holding the pressing terminal in a rear portion thereof. The pressing terminal holding region has a tiered shape that an upper surface of a rear region thereof is situated in a lower position than an upper surface of a front region thereof. A plurality of pressing terminal fitting holes 22 is provided in the rear region and the front region. The pressing terminals 60 and 70 are inserted and held in the pressing terminal fitting hole 22. In the embodiment, the pressing terminal fitting hole 22A is situated in the rear region and the pressing terminal fitting hole 22B is situated in the front region.

As shown in FIG. 1(A), the plurality of the pressing terminal fitting holes 22A and 22B are arranged in zigzag in the width direction of the second housing 20, respectively, and penetrates the second housing in the vertical direction as shown in FIGS. 2(A) and 2(B). Further, as shown in FIGS. 2(A) and 2(B), inner surfaces of the pressing terminal fitting holes 22A and 22B include supporting portions 22A-1 and 22B-1 having a tiered shape, respectively. The supporting portions 22A-1 and 22B-1 support the abutting portions 63A-3 and 73A-3 of the pressing terminals 60 and 70 from the lower direction, respectively.

As shown in FIGS. 1(A) and 1(B), the second housing 20 further includes an attachment portion 23 in a further rear portion of the pressing terminal holding region thereof. The attachment portion 23 protrudes toward outside in the width direction of the second housing 20. As described later, the attachment portion 23 engages an attachment piece 31 of the wire holding member 30, described later, upon assembling the modular jack 1.

As shown in FIGS. 1(A) and 1(B), both ends in the width direction of a middle upper portion of the second housing 20 recess inward in the width direction of the second housing 20 and in the lower direction. An attachment surface for attaching an attachment portion 43 of the metal shell 40 is formed on a lower surface of inner wall surfaces of a portion thus recessed. In addition, the second housing 20 includes a held portion held by a holding portion 44 of the metal shell 40, described later. The held portion is formed at both side end portions in a rear end portion of the second housing 20.

The wire holding member 30 includes a shaft portion (not shown) supported by the second housing 20 at a front end side of the modular plug 1. The wire holding member 30 is attached to the second housing 20 so as to rotate around the shaft portion freely between an open position in which the wire can be attached thereto as shown in FIG. 1(A) and a closed position in which the wire can be pressed as shown in FIG. 1(B). The wire holding member 30 is apart from the second housing 20 in the open position and is close to the second housing 20 in the closed position.

As shown in FIG. 1(B), the wire holding member 30 includes the attachment piece 31 in a rear end portion thereof. The attachment piece 31 extends in the lower direction from a lower edge of both side portions in a width direction of the wire holding member 30 (also refer to FIG. 1(A)). The attachment piece 31 has a plate surface perpendicular to the width direction and is capable of elastic deformation in the width direction. In addition, an attachment window portion 31A is opened being penetrated the attachment piece 31 in the width direction.

As shown in FIGS. 1(A) and 2(A), the wire holding member 30 includes a plurality of wire holding grooves 32 for holding the wires C1 arranged in the lower level and a plurality of wire holding channels 33 for holding the wires C1 arranged in the upper level in a rear half portion thereof. The wire holding grooves 32 and the wire holding channels 33 are arranged in two levels in the vertical direction, so as to correspond to the pressing portions 61 and 71 of the pressing terminals 60 and 70 arranged in the second housing 20, respectively. In the closed position, the plurality of the wire holding grooves 32 extends in the front and rear direction and arranged next to each other in the width direction in a lower portion of the rear half portion of the wire holding member 30.

As shown in FIG. 2(A), the wire holding groove 32 has a cross-sectional shape of an upside-down U-shape. As shown in FIG. 1(A), the wire holding groove 32 includes a pair of holding protrusions 32A protruding from an inner surface thereof. A plurality of the pairs of the holding protrusions 32A is arranged in the front and rear direction (the vertical direction in FIG. 1(A)). The wire C1 arranged in the lower level is held in the wire holding groove 32 by being pressed between the pair of the holding protrusions 32A from the lower direction (from a right side in FIG. 1(A)).

Furthermore, as shown in FIGS. 2(A) and 2(B), the wire holding channel 33 is situated an upper position of the wire holding groove 32. The plurality of the wire holding channels 33 extends in the front and rear direction (the direction perpendicular to the sheet surface) and arranged next to each other in the width direction. The wire holding channel 33 has a circular cross-sectional shape. The wire C1 arranged in the upper level is inserted into the wire holding channel 33 from the rear direction and held in the wire holding channel 33. The wire holding channel 33 has an inner diameter being smaller as proceeding forward and the inner diameter at a front portion thereof is smaller than an outer diameter of the wire C1.

As shown in FIG. 2(A), the wire holding member 30 includes a pressing terminal insertion hole 34 extending in the upper direction at a position corresponding to the pressing terminal 60. Further, as shown in FIG. 2(B), the wire holding member 30 includes a pressing terminal insertion hole 35 extending in the upper direction at a position corresponding to the pressing terminal 70. The pressing terminal insertion hole 34 communicates with the wire holding grove 32 and the wire holding channel 33, and the pressing terminal insertion hole 35 communicates with the wire holding channel 33. Further, the pressing portion 61 of the pressing terminal 60 arranged in the rear row and protrudes in the upper direction from the pressing terminal fitting hole 22A of the second housing 20 is settled in the pressing terminal insertion hole 34. Furthermore, the pressing portion 71 of the pressing terminal 70 arranged in the front row and protrudes in the upper direction from the pressing terminal fitting hole 22B of the second housing 20 is settled in the pressing terminal insertion hole 34.

The metal shell 40 is formed by bending a metal plate after punching out the metal plate. As shown in FIGS. 2(A) and 2(B), both side ends of the metal shell 40 are bent at a right angle in the upper direction. Therefore, the metal shell 40 includes a bottom plate portion 41 with a plate surface perpendicular to the vertical direction and two side plate portions 42 composed of the side ends thus bent. In addition, the metal shell 40 has an upside-down U-shape composed of the bottom plate portion 41 and the side plate portions 42 as being viewed in the front and rear direction.

As shown in FIGS. 1(A) and 1(B), the side plate portion 42 has a groove cut in the vertical direction in a front side portion thereof, thereby forming an attaching portion 43 for attaching to the attachment surface of the second housing 20. Further, the side plate portion 42 is cut in a rear side portion thereof and includes a holding portion 44 for attaching to the held portion of the second housing 20 in rear of where the metal shell 40 is thus cut.

The modular plug 1 is assembled in a following order. First, the pressing terminals 60 and 70 are inserted into the pressing terminal fitting holes 22A and 22B of the second housing 20 from the upper direction, respectively. The connecting portions 62 and 72 at a lower end of the pressing terminal 60 and 70 protrude in the lower direction from the pressing terminal fitting holes 22A and 22B as the pressing terminals 60 and 70 are fitted into the pressing terminal fitting holes 22A and 22B, respectively. Further, the connecting portion of the plate terminal is inserted from the upper direction into the plate terminal attaching hole of the substrate 50 and then soldered to the circuit portion of the substrate 50.

Next, the substrate 50 with the plate terminal soldered thereto is placed underneath of the second terminal 20. Consequently, the plate terminal is settled in the plate terminal receiving groove 21 of the second housing 20. In addition, the connecting portions 62 and 72 of the pressing terminals 60 and 70 protruding in the lower direction from the pressing terminal fitting holes 22A and 22B of the second housing 20 is inserted into the pressing terminal attaching holes 51 of the substrate 50 from the upper direction. The connecting portions 62 and 72 of the pressing terminals 60 and 70 are soldered to the circuit portion of the substrate 50. Thereby, the plate terminal and the pressing terminals 60 and 70 obtain electrical continuity through the circuit portion of the substrate 50.

Next, the shaft portion (not shown) of the wire holding member 30 is put into a shaft supporting portion (not shown) of the second housing 20 in order to be supported, as well as attaching the first housing 10 to the second housing 20 from the lower direction. As a result, the wire holding member 30 is attached to the second housing 20 so as to rotate freely between the open position and the closed position around the shaft portion. In the embodiment, an engaging portion (not shown) of the first housing 10 engages an engaged portion (not shown) of the second housing 20 in the vertical direction, thereby attaching the first housing 10 to the second housing 20.

As the first housing 10 is attached to the second housing 20, the first housing 10 and the second housing 20 sandwich the substrate 50. Accordingly, the first housing 10 and the second housing 20 hold indirectly the pressing terminals 60 and 70 attached to the substrate 50.

Next, the metal shell 40 is attached to the first housing 10 and the second housing 20 from the lower direction. More specifically, the attaching portion 43 and the holding portion 44 are bent so as to wrap both of the first housing 10 and second housing 20, in other words, bent inward in the width direction of the first housing 10 and the second housing 20. As a result, a plate surface of an upper end portion of the attaching portion 43 abuts against the attachment surface of the second housing 20, thereby holding the second housing 20 with a portion where the attachment surface is situated. In addition, the holding portion 44 holds the held portion of the second housing 20 (refer to FIGS. 1(A) and 1(B)). Accordingly, it is possible to maintain a state that the first housing 10 and second housing 20 sandwich the substrate 50 stably. As described above, the modular plug 1 is assembled completely.

Next, a process of connecting the wire C1 to the modular plug 1 will be explained. First, as shown in FIG. 1(A), the wire C1 is held in the wire holding member 30. More specifically, the wire holding member 30 attached to the second housing 20 so as to rotate freely is placed on the open position. In other words, the wire holding member 30 is placed so as to be apart from the second housing 20 or extend in the vertical direction as shown in FIG. 1(A). Then the wire C1 is inserted into the wire holding groove 32 arranged in the lower level of the wire holding member 30, as well as inserting the wire C1 into the wire holding channel 33 arranged in the upper level as the wire holding member 30 is in the open position.

The wire C1 is inserted into the wire holding groove 32 from an opening of the wire holding groove 32, that is, the right side in FIG. 1(A). The wire C1 is pressed between the pair of the holding protrusions 32A of the wire holding groove 32.

In addition, as described above, the inner diameter of the front portion of the wire holding channel 33 is smaller than the outer diameter of the wire C1. Therefore, a front portion of the wire C1 is forcibly inserted and held in the wire holding channel 33. As a result, it is possible to prevent the wire C1 from coming off from the wire holding member, since the wire C1 is held steadily in the wire holding member 30.

Next, as the wire C1 is held in the wire holding member 30, the wire holding member 30 is rotated toward the second housing 20, that is, to the closed position. Thereby, the wire C1 in the lower level is pressed into the pressing groove portion 64 of the pressing terminal 60 from the upper direction and the wire C1 in the upper level is pressed into the pressing groove portion 74 of the pressing terminal 70 from the upper direction. Next, as shown in FIG. 1(B), the attachment portion 23 of the second terminal 20 enters and then engages the window portion 31A of the attachment piece 31 of the wire holding member 30 in the vertical direction. Thereby, the wire holding member 30 is fixed to the second housing 20.

Hereunder, referring to FIG. 3(A), a process of pressing the wire C1 in the pressing grove portion 64 of the pressing terminal 60 will be explained. An explanation about the pressing terminal 70 will be omitted since a process of pressing the wire C1 in the pressing grove portion 74 of the pressing terminal 70 is similar to the process of the pressing terminal 60. In the embodiment, a diameter of the core wire C1A of the wire C1 shown in FIG. 3(A) is larger than a width of the pressing groove portion 64.

When the pressing groove portion 64 receives the wire C1 from the upper direction, a lower portion of the outer jacket C1B of the wire C1 abuts against an upper portion of the opening portion of the pressing groove portion 64, that is, the upper inner edge portion of the transition portions 63B. The diameter of the wire C1 is larger than the width of the pressing groove portion 64. Therefore, when the wire C1 is pressed into the pressing groove portion 64, an outer surface of the outer jacket C1B abuts against the inner edge portion of the transition portion 63B with a contact pressure as the wire C1 is situated within a range of the transition portion 63B in the vertical direction. Accordingly, a pair of the elastic arm portions 63 is deformed elastically so as to be apart from each other, in other words, to widen the pressing groove portion 64, by the outer surface of the outer jacket C1B thus abutting.

In the embodiment, as shown in FIG. 3(A), the transition portion 63B is as long as the diameter of the wire C1 in the vertical direction. Accordingly, in the embodiment, when the wire C1 is situated within the range of the transition portion 63B in the vertical direction, the wire C1 does not apply stress to the second arm portion 63C yet since the transition portion 63B has a sufficient length in the vertical direction. At this point, the wire C1 applies the stress to the transition portion 63C only. As a result, only the first arm portion 63A deforms elastically around the base portion 63A-1 and the second arm portion 3C situated lower than the transition portion 63B does not deform elastically. Therefore, only the base portion 63A-1 of the first arm portion 63A receives the stress.

As described above, when the wire C1 is situated in the range the transition portion 63B in the vertical direction, only the base portion 63A-1 of the first arm portion 63A receives the stress. As being pressed downward further, the wire C1 quickly passes the range of the transition portion 63B in the vertical direction. As a result, the stress is not applied to only the base portion 63A-1 for a long period of time. Consequently, the elastic arm portion 63 does not diminish restoring force thereof.

As described above, the inner edge portions of the transition portion 63 and the second arm portion 63C form the contact blade 65. Therefore, when the wire C1 situated within the range of the transition portion 63B in the vertical direction is pressed downward further, the contact blade 65 bites the outer jacket C1B of the wire C1, cutting the outer jacket C1B. Further, as shown in FIG. 3(A), when the wire C1 reaches in a range of the second arm portion 63C in the vertical direction, the second arm portion 63C is situated inside the outer jacket C1B and an inner edge portion of the second arm portion 63C contacts the core wire C1A of the wire C1 with the contact pressure. Accordingly, the pressing terminal 60 and the wire C1 contact each other with the contact pressure, thereby obtaining electrical continuity. Thus the wire C1 and the pressing terminal 60 are pressed and connected to each other completely.

As described above, the diameter of the core wire C1A is larger than the width of the pressing groove portion 64, in other words, larger than a distance between the inner edges of the second arm portion 63C facing each other. Accordingly, as shown in FIG. 3(A), as well as the first arm portion 63A, the second arm portion 63C deforms elastically around the base portion 63C-1 of the second arm portion 63C so that the second arm portions 63C are apart from each other when the inner edge of the second arm portion 63C contacts the core wire C1A of the wire C1.

At this point, the contact blade 65 cuts the outer jacket C1B and then the second arm portion 63C enters the outer jacket C1B. Therefore, compare to the case that the wire C1 is situated in the range of the transition portion 63B in the vertical direction, the first arm portion 63A deforms toward the pressing groove portion 64 to be restored, in other words, to narrow the pressing groove portion 64. Meanwhile, the diameter of the core wire C1A of the wire C1 is larger than the width of the pressing groove portion 64. Accordingly, the first arm portion 63A is not fully restored to a free state, in spite of being less deformed. In addition, the contact blade 65 of the inner edge of the second arm portion 63C maintains a state of contacting the core wire C1A of the wire C1 with the contact pressure. As a result, it is possible to maintain a state that the wire C1 contacts the pressing terminal 60 stably since the wire C1 is not extracted easily in the upper direction.

The second arm portion 63C is situated close to the base portion 63A-1 of the first arm portion 63A. Therefore, essentially, the base portion 63A-1 of the first arm portion 63A receives the relatively large stress. In the embodiment, since the elastic arm portion 63 includes the second arm portion 63C adding to the first arm portion 63A, the base portion 63C-1 of the second arm portion 63C also receives the stress. Therefore, it is possible to reduce the stress the base portion 63A-1 of the first arm portion 63A receives.

Consequently, the elastic arm portion 63 does not diminish the restoring force thereof since the pressing terminal 60 receives lesser burden. Therefore, it is possible to maintain the state that the contact blade 65 of the second arm portion 63C contacts the core wire C1A of the wire C1 with the sufficient contact pressure for a prolonged period. Further, the second arm portion 63C is situated close to the base portion 63A-1 of the first arm portion 63A in the vertical direction. Accordingly, the elastic arm portion 63 as a whole can be capable of deforming elastically with a sufficient amount, since both of the first arm portion 63A and the second arm portion 63C deform elastically together though the first arm portion 63A deforms elastically with a little amount, independently.

In the embodiment, an amount of elastic deformation of the first arm portion 63A and the second arm portion 63C, in other words, elasticity of the elastic arm portion 63 varies depending on a position of the wire C1 in the vertical direction. The position of the core wire C1A of the wire C1 in the vertical direction, that is, where the wire C1 is pressed, varies depending on the diameter of the wire C1. According to the embodiment, since the elasticity of the elastic arm portion 63 varies, the elastic arm portion 63 can obtain an optimal contact consistently, depending on where the wire C1 is pressed.

In addition, when the wire C1 is inserted into the pressing groove portion 64, the wire C1 can move in a direction perpendicular to a direction the wire C1 is inserted (the lower direction) or the horizontal direction in FIG. 3(A). In the embodiment, the first arm portion 63A includes the regulating protrusion portion 63A-2 within the range of the second arm portion 63C in the vertical direction. Since the second arm portion 63C deforming elastically abuts against the regulating protrusion 63A-2, the regulating protrusion portion 63A-2 regulates the second arm portion 63C to deform elastically within a specific range.

Consequently, the second arm portion 63C is regulated to deform elastically too much as the wire C1 moves. Accordingly, since the base portion 63C-1 of the second arm portion 63C and the base portion 63A-1 of the first arm portion 63A are not overstressed, the pressing terminal 60 is not damaged due to being overstressed. In addition, when the wire being inserted is thicker than the wire C1 shown in FIG. 3(A), the second arm portion 63C is regulated to deform elastically too much thanks to the regulating protrusion portion 63A-2, thereby obtaining the same effect as described above.

Further, in the modular plug 1 according to the embodiment, as shown in FIG. 3(B), the wire C2 which is thinner than the wire C1 can be pressed as well. The wire C2 includes the core wire C2A thinner than the core wire C1A of the wire C1 and an outer jacket C2B for covering the core wire C2A. The core wire C2A has a diameter equivalent to the width of the pressing groove portion 64 and slightly larger than a distance of the pressing protrusion portions 63C-2 of the second arm portions 63C facing each other. As shown in FIG. 3(B), when the wire C2 is completely pressed and connected to the pressing terminal 60, the core wire C2A of the wire C2 is sandwiched and pressed by the pressing protrusion portions 63C-2. As well as a case that the wire C1 is inserted, both of the first arm portion 63A and the second arm portion 63C deform elastically in spite of less deforming elastically compare to the case that the wire C1 is inserted.

Ordinary, the wires C1 and C2 are inserted into the pressing groove portion 64 by using a specialized jig from the upper direction. The same jig is used regardless of a thickness of the wire. Generally, the jig has an unchanged stroke and presses the wire by moving a lower end surface thereof downward to the same point in the vertical direction. Accordingly, as it is apparent by comparing FIG. 3(A) to FIG. 3(B), when the wire is inserted completely, the core wire C1A of the wire C1 which is thicker is situated in a lower position than the core wire C2A of the wire C2 which is thinner.

Therefore, when the wire C1 which is thicker is inserted, the second arm portion 63C can deform elastically in a relatively larger amount, since a distance between the base portion 63C-1 of the second arm portion 63C and where the wire is pressed becomes relatively longer due to the core wire C1A of the wire C1 situated at the lower position than the core wire C2A of the wire C2. As a result, it is possible to prevent the base portion 63C-1 from receiving the stress in a large amount though the second arm portion 63C receives a load in a large amount as the wire C1 which is thick is inserted.

In the embodiment, the transition portion is formed with a length on the vertical direction so that only the first arm portion deforms elastically as the wire is situated in the range of the transition portion in the vertical direction. Instead, both of the first arm portion and the second arm portion may deform elastically as soon as it is started to press the wire into the pressing groove portion by making the transition portion shorter in the vertical direction, or providing a groove portion between the first arm portion and the second arm portion which is long enough to be close to an upper end of the elastic arm portion.

Second Embodiment

Figure 4B:
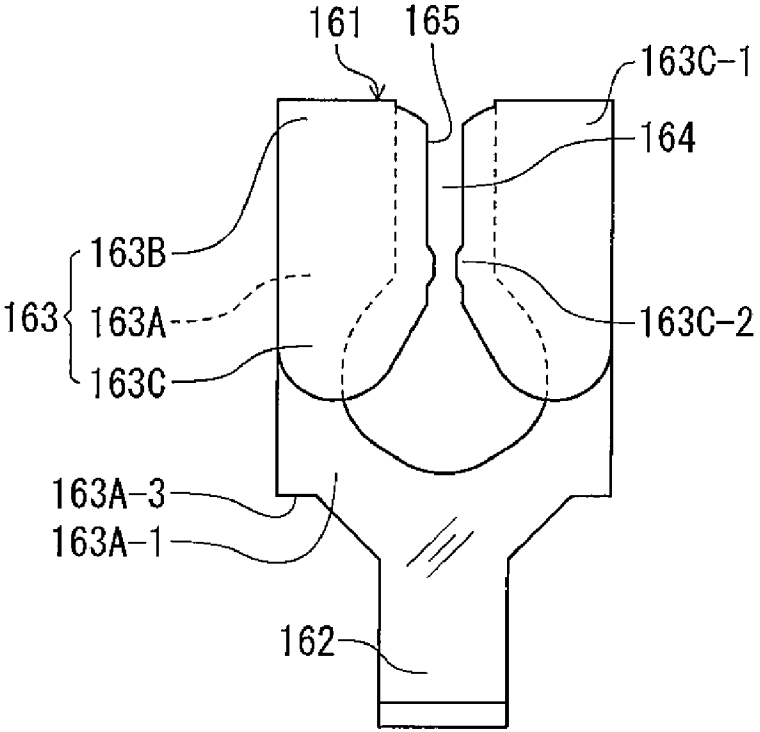
Figure 4A:
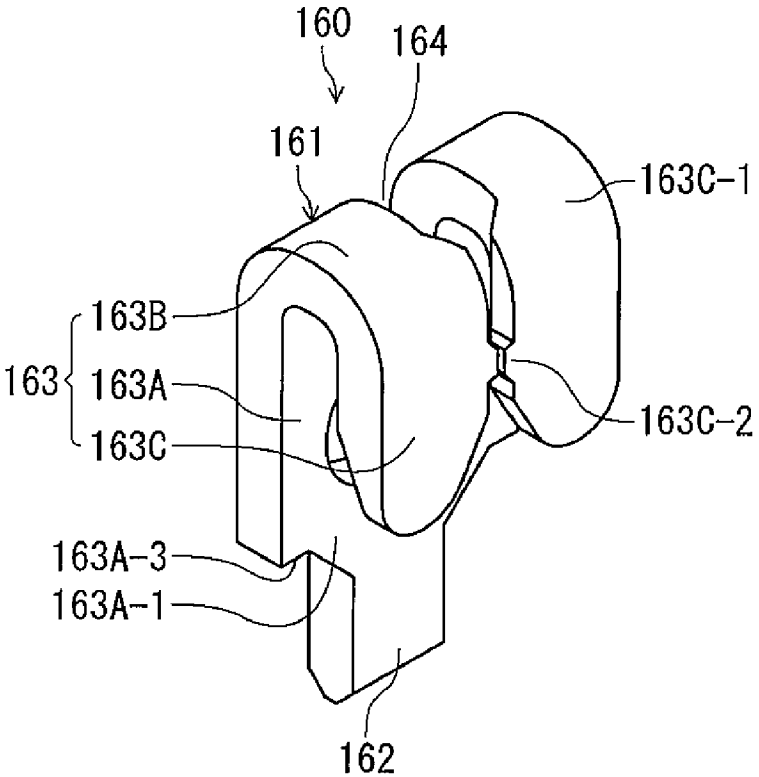

In a second embodiment of the present invention, the elastic arm portion of the pressing terminal is bent in the thickness direction of the metal plate while the elastic arm portion is formed so as to maintain the flat plate surface in the first embodiment. FIGS. 4(A) and 4(B) are views showing the pressing terminal according to the embodiment, wherein FIG. 4(A) is a perspective view thereof and FIG. 4(B) is a front view thereof. A configuration of the pressing portion of the pressing terminal in the embodiment is different from the pressing terminal in the first embodiment and will be explained mainly. In FIGS. 4(A) and 4(B), components in the embodiment are given reference numerals adding 100 to the reference numerals of the corresponding components in the first embodiment, respectively.

A pressing terminal 160 (corresponding to the pressing terminal 60 in the first embodiment) according to the embodiment includes a pressing portion 161. The pressing portion 161 includes two elastic arm portions 163. Each of the elastic arm portions 163 includes a first arm portion 163A, a transition portion 163B and a second arm portion 163C. The first arm portion 163A further includes a base portion 163A-1 connected to a connecting portion 162 and extends from the base portion 163A-1 thereof to an opening portion of a pressing grove portion 164, in other words, extends in the upper direction. The transition portion 163B has a curved shape curving from a distal end of the first arm portion 163A in the thickness direction of the metal plate. The second arm portion 163C extends in parallel with the first arm portion 163A from the transition portion 163B to the base portion 163A-1, that is, in the lower direction. As shown in FIG. 4(A), the elastic arm portion 163 is formed by bending in the thickness direction of the metal plate so that the transition portion 163B is folded.

The first arm portion 163A is capable of elastic deformation around the base portion 163A-1 in a plain parallel with the metal plate so as to open the pressing groove portion 164. Further, the second arm portion 163C is capable of elastic deformation around a base portion 163C-1 or a portion adjacent to the transition portion 163B in a direction perpendicular to the thickness of the metal plate. In the embodiment, a contact blade 165 is formed in an inner edge portion of the second arm portion 163C, and is not formed in an inner edge portion of the first arm portion 163A. As shown in FIGS. 4(A) and 4(B), the contact blade 165 includes a pressing protrusion portion 163C-2 in the inner edge portion thereof. The pressing protrusion portions 163C-2 of a pair of the second arm portions 163C facing each other protrude so as to come close to each other.

In the embodiment, as shown in FIG. 4(B), the inner edge portion of the second arm portion 163C is situated inner side than the inner edge portion of the first arm portion 163A. Therefore, when a wire (not shown) is inserted into the pressing groove portion 164 of the pressing terminal 160, a lower portion of the wire abuts against the inner edge portion of the second arm portion 163C first as the wire is situated within a range of the transition portion 163B in the vertical direction, thereby, only the second arm portion 163C deforms elastically. As the wire is inserted downward further, the first arm portion 163A also deforms elastically as the wire reaches in a range of the second arm portion 163C in the vertical direction.

The pressing terminal 160 according to the embodiment is relatively short in the vertical direction since the elastic arm portion 163 is bent as described above. Consequently, it is possible to downsize the connector including the pressing terminal 160, for example, the modular plug, in the vertical direction.

Third Embodiment

In a third embodiment according to the present invention, the connector is connected to the mating connector as the connecting portion of the pressing terminal contacts the terminal of the mating connector (the mating terminal), while the connecting portion of the pressing terminal is connected to the circuit portion of the substrate in the first embodiment.

Figure 5:
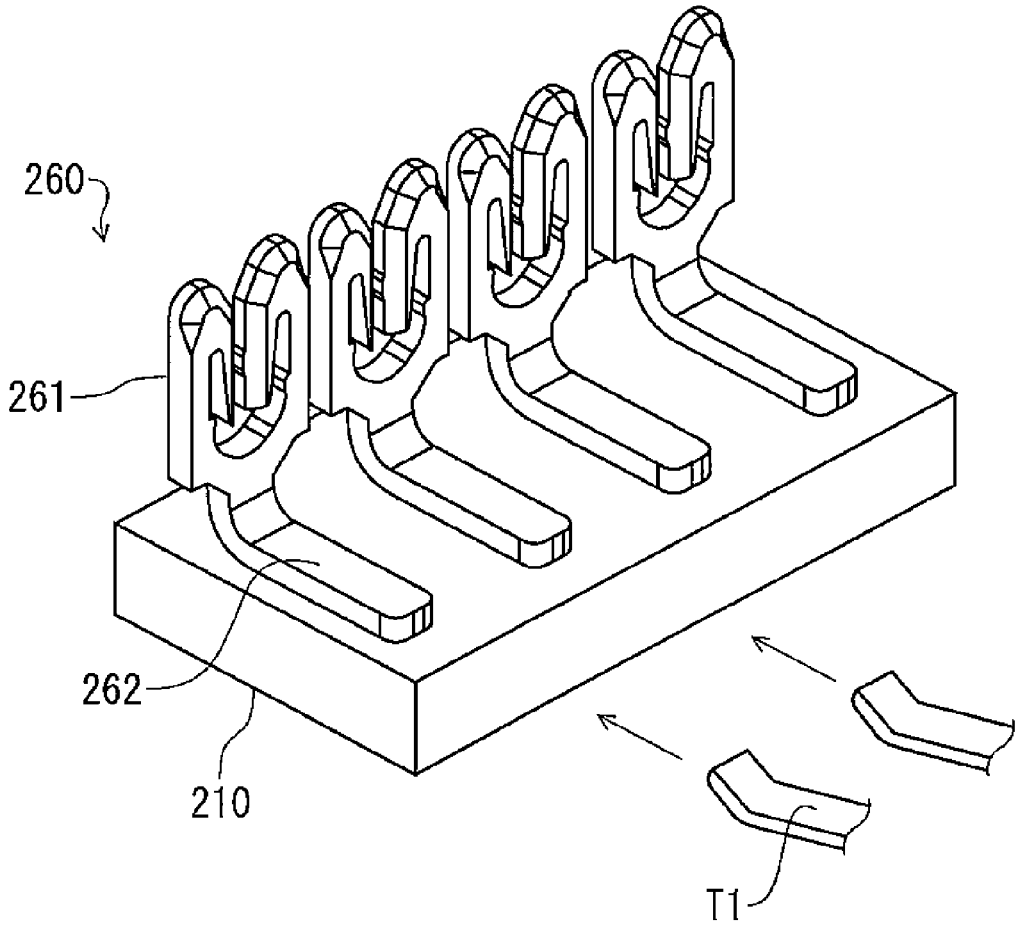
FIG. 5 is a perspective view showing a terminal of an electrical connector according to a third embodiment of the present invention.

FIG. 5 is a perspective view showing a pressing terminal according to the embodiment. As shown in FIG. 5, a pressing terminal 260 according to the embodiment contacts a mating connector T1 having a shape of a spring piece. The pressing terminal 260 includes a pressing portion 261 and a connecting portion 262. The connecting portion 262 is bent in the thickness direction of the plate so as to have a right angle to the pressing portion 261 at a combined portion with the pressing portion 261. In other words, the connecting portion 262 extends from the combined portion in the rear direction (a right direction in FIG. 5). In addition, a plurality of the pressing terminal 260 is arranged in a housing 210 by being supported with the housing 210 at a lower surface of the connecting portion 262. The pressing portion 261 of the pressing terminal 260 has the same configuration with the pressing portion 61 of the pressing terminal 60 in the first embodiment, thus an explanation thereof will be omitted.

The mating terminal T1 has the shape of the spring piece with a metal piece having a strip shape. A front end portion of the metal piece is bent slightly upward. The mating terminal T1 comes in contact with the connecting portion 262 of the pressing terminal 260 from the rear direction (refer to arrows in FIG. 5). An upper surface of the connecting portion 262 contacts a lower surface of the mating terminal T1.

Fourth Embodiment

In a fourth embodiment according to the present invention, the connecting portion of the pressing terminal obtains elasticity and contacts the mating terminal elastically, in contrast to the third embodiment in which the connecting portion of the pressing terminal does not obtain the elasticity and the mating terminal obtains elasticity.

Figure 6:
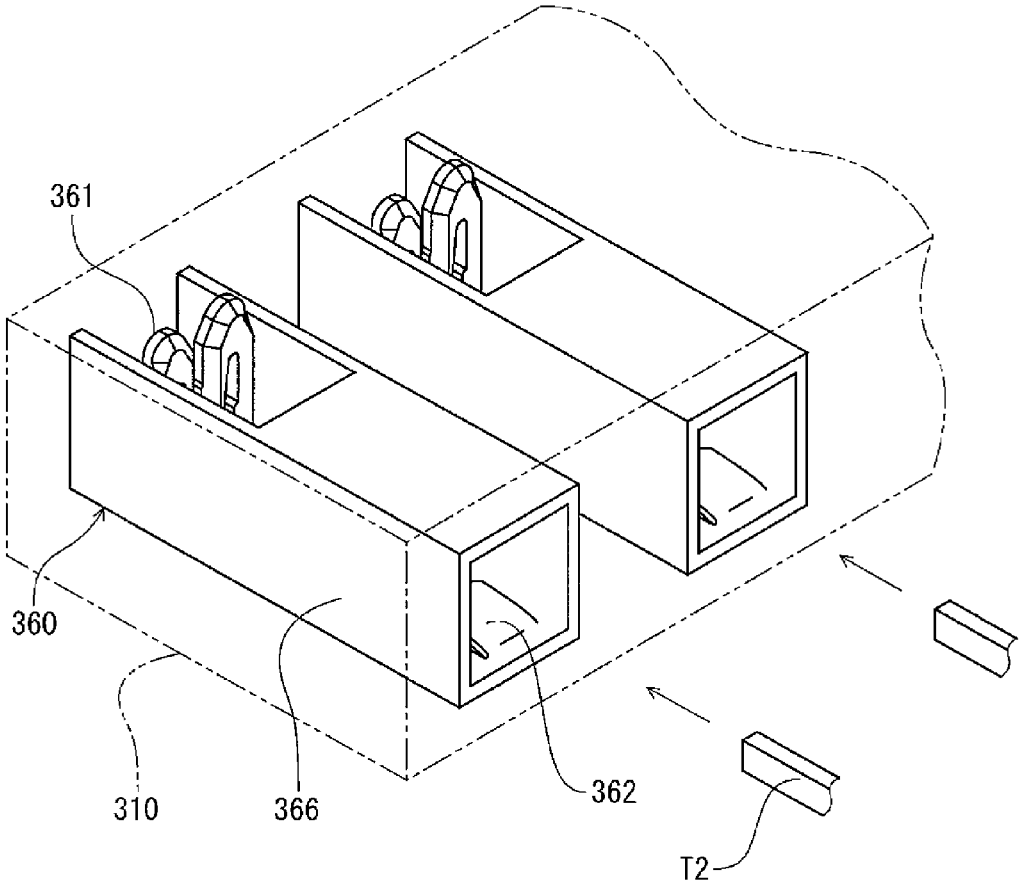
FIG. 6 is a perspective view showing a terminal of an electrical connector according to a fourth embodiment of the present invention.

FIG. 6 is a perspective view showing a pressing terminal according to the embodiment. As shown in FIG. 6, the pressing terminal 360 in the embodiment contacts a mating terminal T2 having a pin shape. The pressing terminal 360 has a box shape formed by bending a plate member. The plate member is obtained by punching out a metal plate. The pressing terminal 360 is disposed in a housing 310 which is shown with a projected line in FIG. 6.

As shown in FIG. 6, the pressing terminal 360 includes a tube portion 366 extending in the front and rear direction (a horizontal direction in FIG. 6) and having a shape of a substantially rectangular tube. The tube portion 366 includes a pressing portion 361 for pressing a wire and a connecting portion 362 with a shape of a spring piece. The pressing portion 361 is situated in a front end portion (a left direction in FIG. 6) and the connecting portion 362 is situated in a rear end portion of the tube portion 366, respectively. The pressing portion 361 has the same configuration with the pressing portion 61 of the pressing terminal 60 in the first embodiment, thus an explanation thereof will be omitted.

In the pressing terminal 360, an upper wall of the tube portion 366 is cut at a position the pressing portion 361 is situated so that the pressing portion 361 receives the wire (not shown) from the upper direction. The connecting portion 362 has a spring shape extending in the front direction being slightly upward toward the front direction. The tube portion 366 includes a tongue piece formed by cutting a rear end portion of a lower wall thereof. The connecting portion 362 is formed by bending the tongue piece upward toward the front direction.

The mating terminal T2 with the pin shape comes in contact with the connecting portion 362 from the rear direction (refer to arrows in FIG. 6). As a result, an upper surface of the connecting portion 362 contacts a lower surface of the mating terminal T2.

Fifth Embodiment

In a fifth embodiment of the present invention, the second arm portion of the pressing terminal includes a pressing region on an inner edge portion thereof. The pressing region defines a pressing position of the wire in the vertical direction. On the other hand, in the first embodiment, the inner edge portion of the second arm portion does not include the pressing region and simply contacts the wire at a position where the wire is inserted.

Figure 7B:
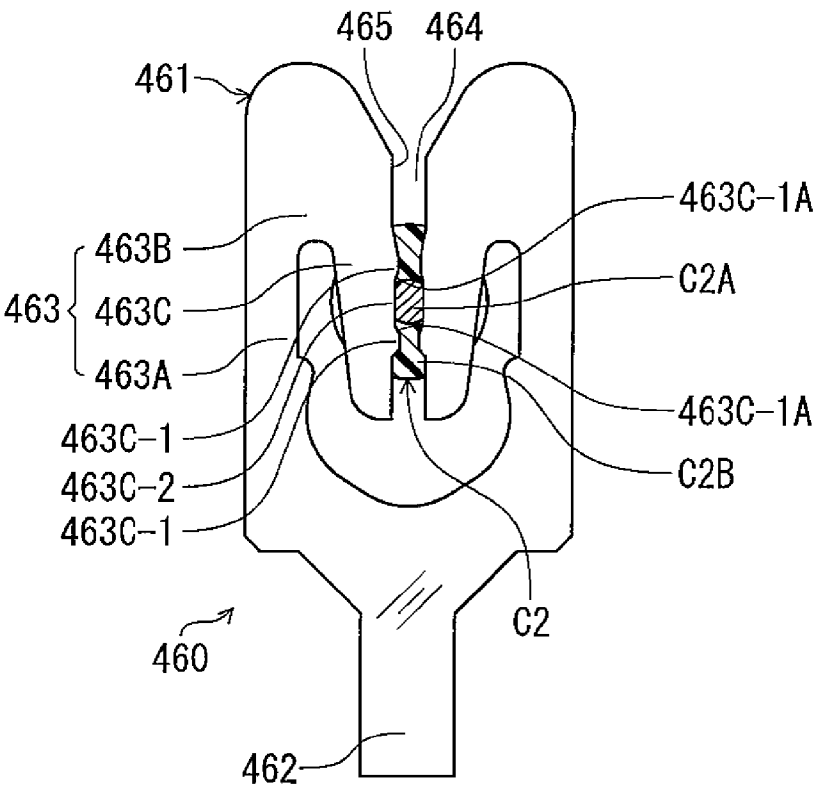
Figure 7A:
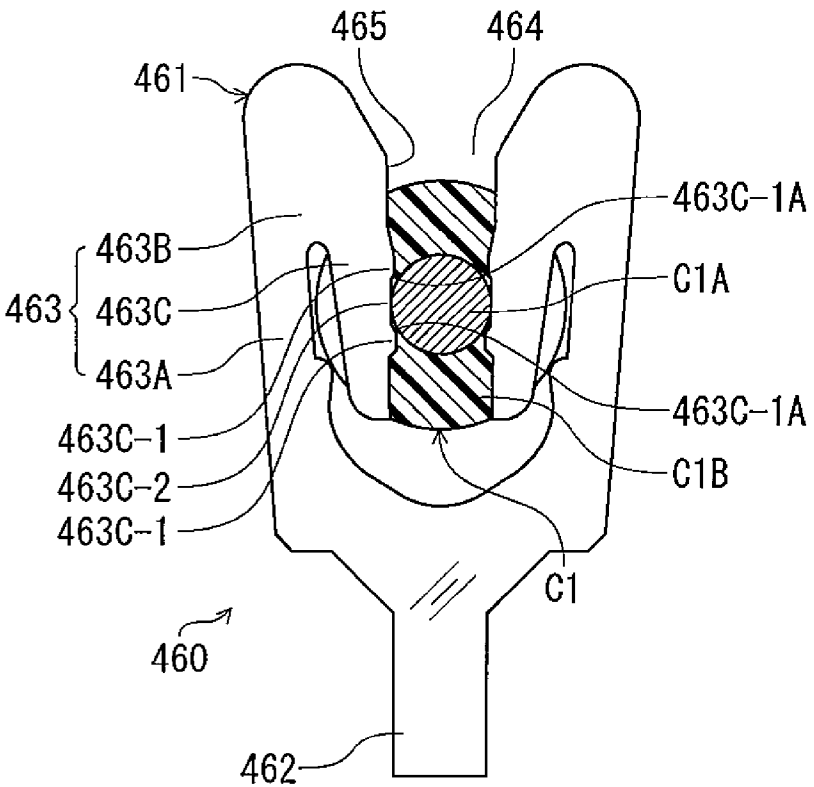

FIGS. 7(A) and 7(B) are sectional views showing a pressing terminal 460 and wires C1 and C2 according to the embodiment. FIG. 7(A) shows a state that the pressing terminal 460 presses the thick wire C1 and FIG. 7(B) shows a state that the pressing terminal 460 presses the thin wire C2. In FIGS. 7(A) and 7(B), components in the embodiment are given reference numerals adding 400 to the reference numerals of the corresponding components in FIGS. 2(A) and 2(B), respectively. As shown in FIGS. 7(A) and 7(B), in the embodiment, the wire is inserted in the pressing groove portion 464 until core wires C1A and C2A reach to a specific position in the vertical direction regardless of thicknesses thereof.

When the wire is not inserted into the pressing groove portion 464, inner edge portions of two second arm portions 463C facing each other of the pressing terminal 460 extend in parallel in the vertical direction without slanting. The inner edge portion includes two protrusions 463C-1 in a substantially middle portion thereof. The two protrusions 463C-1 are arranged with a distance from each other. A region between the protrusions 463C-1 forms a bottom region 463C-2 contacting the wires C1 and C2 when the wires C1 and C2 are inserted completely. Further, a rising edge 463C-1A rising from both end portions of the bottom region 463C-2 is provided. As described later, the rising edge 463C-1A regulates the core wires C1A and C2A to move in the vertical direction. The pressing region is composed of the bottom region 463C-2 and the rising edge 463C-1A for defining the pressing position of the wires C1 and C2 in the vertical direction. As shown in FIGS. 7(A) and 7(B), an opening portion of the pressing groove portion 464, that is, a distance of a pair of the inner edge portions becomes the narrowest where the bottom region 463C-2 is situated, except where the protrusion 463C-1 is provided.

In the embodiment, when the wires C1 and C2 are inserted completely, the core wires C1A and C2A are situated in regular positions, that is, within the bottom region 463C-2 in the vertical direction, respectively. The core wires C1A and C2A are situated within the bottom region 463C-2 and contact the inner edge portion of the second arm portion 463C with a contact pressure. A pair of the bottom regions 463C-2 maintains to be parallel with each other as contacting the core wires C1A and C2A.

In the embodiment, when an external force in the vertical direction is applied to the wires C1 and C2 inadvertently, the core wires C1A and C2A of the wires C1 and C2 abut against the rising edge 463C-1A, thereby being regulated further movement thereof. Accordingly, the core wires C1A and C2A are kept within the bottom region 463C-2. As a result, it is possible to attain a stable pressing contact at the regular position.

In the embodiment, as shown in FIGS. 7(A) and 7(B), the pair of the inner edge portions of the second arm portions 463C extends parallel with the vertical direction. When the inner edge portions extend tilting against the vertical direction, the core wires C1A and C2A receive a force in the vertical direction from the inner edge portion though the external force described above is not applied thereto inadvertently. For example, when the inner edge portions tilt so as to open toward the upper direction, the core wires C1A and C2A receive the force in the upper direction. When the inner edge portions tilt so as to open toward the lower direction, the core wires C1A and C2A receive the force in the lower direction. Even though the core wires C1A and C2A receive the force in the vertical direction, the rising edge 463C-1A regulates the movement of the core wires C1A and C2A. Consequently, the core wires C1A and C2A are kept within the bottom region 463C-2. Thereby, it is possible to attain the stable pressing contact at the regular position.

In addition, in a case that a plurality of the wires C1 and C2 are inserted into the pressing groove portions of the corresponding terminals to a specific position using a wire holding member or a jig, though the thickness of the wires varies due to a manufacturing error and so on, the wires C1A and C2A thus inserted can be kept within the bottom region 463C-2 since the rising edge 463C-1A regulates the further movement in the lower direction of the core wires C1A and C2A once the core wires C1A and C2A reach the bottom region 463C-2.

In the embodiment, the pressing region is formed by providing two protrusions in the inner edge portion of the second arm portion. Configurations of the pressing region are not limited to the case described above. The pressing region may be composed of the bottom region for contacting the core wire when the wire is inserted completely and the rising edge rising from both end portions of the bottom region. For example, the pressing region may be formed by providing a recess portion in the inner edge portion. In this case, the pressing region is composed of the bottom region of the recess portion and the rising edge rising from both ends of the recess portion.

The disclosures of Japanese Patent Application No. 2010-138483 filed on Jun. 17, 2010, and Japanese Patent Application No. 2009-225682, filed on Sep. 30, 2009, are incorporated in the application by reference.

While the invention has been explained with reference to the specific embodiments of the invention, the explanation is illustrative and the invention is limited only by the appended claims.

What is claimed is:

1. An electrical connector, comprising:

a housing; and a terminal disposed in the housing, said terminal including a pressing portion for receiving a wire and a connecting portion extending from the pressing portion, said pressing portion including two elastic arm portions and a pressing groove portion between the elastic arm portions, each of said elastic arm portions including a base portion extending from the connecting portion, a first arm portion extending from the base portion toward an opening portion of the pressing groove portion, a transition portion in a curved shape at a distal end portion of the first arm portion, and a second arm portion extending toward the base portion in parallel to the first arm portion so that the elastic arm portions contact with the wire at inner edge portions of the second arm portions when the wire is inserted into the pressing groove portion, wherein each of said second arm portions includes a pressing protrusion portion on the inner edge portion so that the pressing protrusion portions are situated away from each other by a distance smaller than that between the inner edge portions when the wire is inserted into the pressing groove portion.

2. The electrical connector according to claim 1, wherein said pressing portion is arranged so that one of the first arm portion and the second arm portion elastically deforms when the wire is inserted into the pressing groove portion and situated within a range of the transition portion in an insertion direction, and both of the first arm portion elastically deform when the wire is situated within a range of the second arm portion in the insertion direction.

3. The electrical connector according to claim 1, wherein said second arm portion includes a pressing region on the inner edge portion for defining a pressing position of the wire in the insertion direction, said pressing region including a bottom region for contacting with the wire when the wire is completely inserted and rising edges rising from both end portions of the bottom region.

4. The electrical connector according to claim 1, wherein said first arm portion includes a regulating protrusion portion protruding toward the second arm portion within a range of the second arm portion in an insertion direction of the wire for regulating the second arm portion to deform within a specific elastic deformation range.

5. The electrical connector according to claim 1, wherein said connecting portion is connected to a corresponding circuit portion of a circuit board or a corresponding terminal of a mating connector.

6. The electrical connector according to claim 1, wherein said pressing portion is formed in a curved U-character shape folded backward toward the connecting portion so that the first arm portion faces the second arm portion.

7. The electrical connector according to claim 1, further comprising a tube portion connected to the connecting portion, said tube portion having a cut upper wall so that the terminal receives the wire through the cut upper wall.

* * * * *